US005954532A

United States Patent [19]

Matsuura et al.

[11] Patent Number: 5,954,532

[45] Date of Patent: Sep. 21, 1999

[54] SLIDABLY FITTING TYPE CONNECTOR

[75] Inventors: Toshifumi Matsuura; Shinji Kodama, both of Shizuoka, Japan

[73] Assignee: Yazaki Corporation, Tokyo, Japan

[21] Appl. No.: 09/103,563

[22] Filed: Jun. 24, 1998

[30] Foreign Application Priority Data

Jun. 27, 1997 [JP] Japan ..... 9-172235

[51] Int. Cl.[6] ..... H01R 13/62

[52] U.S. Cl. ..... 439/372

[58] Field of Search ..... 439/157, 310, 439/372

[56] References Cited

U.S. PATENT DOCUMENTS 5,344,194 9/1994 Hatagishi et al. ..... 439/310
5,474,462 12/1995 Yamanashi ..... 439/157

FOREIGN PATENT DOCUMENTS 6-124747 6/1994 Japan .
6-79080 11/1994 Japan .

*Primary Examiner*—Steven L. Stephan
*Assistant Examiner*—Eugene G. Byrd
*Attorney, Agent, or Firm*—Morgan, Lewis & Bockius LLP

[57] ABSTRACT

A slidably fitting type connector in which first and second connector housings fit to each other and are detachable from each other by a slide member for sliding the first and second connector housings in the fitting and detaching directions of the first and second connector housings via a lever which is interlocked with the slide member. The first connector housing has an engaging portion and an unlocking member. The slide member is slidably movable on the second connector housing in the fitted and detached directions of the second connector housing to and from the first connector housing. The slide member has a retaining portion engageable with and disengageable from the engaging portion, and a support shaft. The lever is pivotably supported by the support shaft, and pivots as the slide member is slid on the second connector housing. The first and second connector housings are retained together by an engagement of the retaining portion of the slide member and the engaging portion of the first connector housing, the engagement of the retaining portion and the engaging portion can be released by operating the unlocking member.

18 Claims, 6 Drawing Sheets

SLIDABLY FITTING TYPE CONNECTOR

BACKGROUND OF THE INVENTION

1. Field of the Invention

This invention relates to a slidably fitting type connector in which a slide member is slidably movable reciprocally in fitting and detaching directions of multi-pole female and male connector housings. The connector housings are easily fit to each other and detached from each other due to the leverage of a lever which is pivoted by sliding the slide member with a small operation force.

The present application is based on Japanese Patent Application No. Hei. 9-172235, which is incorporated herein by reference.

2. Description of the Related Art

FIGS. 6A and 6B show an example of a conventional lever type connector 1 which utilizes leverage to move parts. The lever type connector 1 includes a multi-pole female connector housing 2. A slide groove 4 is formed in the frame supporting portion 3 of the female connector housing 2. A slide shaft 6 projects from a lower end side of a frame-shaped lever 5, and is slidably supported in the slide groove 4. Further, a pair of male connector housings 7 and 7 that are fittable to and detachable from the female connector housing 2 are pivotally supported by a shaft 8 within the frame-shaped lever 5.

Connector housings 2 and 7 are fit to and detached from each other by vertically moving a lever operating portion 9 that projects from an upper end side of the lever 5 so that the lever 5 pivots with the slide shaft 6 as a fulcrum. Incidentally, the technique similar to that of the lever type connector 1 is disclosed in Unexamined Japanese Utility Model Publication No. Hei. 6-79080.

In the above-mentioned conventional lever type connector 1, when the male and female connector housings 2 and 7 are fit together they are locked together by a locking mechanism (not shown) provided between both connector housings 2 and 7. The connector housings 2 and 7 are separated by inserting a unlocking jig, such as a screwdriver, into a gap formed between the connector housings 2 and 7. This creates a problem in that it is difficult to operate the lever 5 while separating the connector housings 2 and 7 by using the unlocking jig. Therefore, a high level of skill is required to separate the connector housing 2 and 7.

SUMMARY OF THE INVENTION

An object of the present invention is to eliminate the above-mentioned drawbacks accompanying the conventional lever type connector.

More specifically, an object of the present invention is to provide a slidably fitting type connector with excellent operability wherein the connector housings can be easily locked and can also easily be released.

According to the first aspect of the present invention, a slidably fitting type connector is provided which comprises:

a first connector housing having first and second engaging portions formed therein;

a second connector housing fittable to the first connector housing, the second connector housing having a point-of-action portion formed thereon;

a slide member slidably movable on the second connector housing reciprocally in fitted and detached directions of the second connector housing to and from the first connector housing, the slide member having a support shaft;

a lever including:

a base portion being pivotably supported by the support shaft, wherein the lever pivots as the slide member is slid on the second connector housing, a mid-portion engaged with the point-of-action portion of the second connector housing, and a leading end portion engageable with and disengageable from the first and second engaging portions of the first connector housing when the first and second connector housings are fitted to each other and detached from each other, wherein when the slide member is moved in the fitting direction of the second connector housing, the leading end portion engages with the first engaging portion so that the first and second connector housings are pulled to each other, and when the slide member is moved in the detaching direction of the second connector housing, the leading end portion engages with the second engaging portion so that the first and second connector housings are pulled apart from each other;

a retaining portion formed on the slide member;

an engaging portion engageable with and disengageable from the retaining portion, the engaging portion being formed in the first connector housing; and an unlocking member arranged in the first connector housing, wherein a fitted condition of the first and second connector housings is retainable by an engagement of the retaining portion of the slide member and the engaging portion of the first connector housing, the engagement of the retaining portion and the engaging portion can be released by operating the unlocking member.

Since both connector housings are fitted to each other and simultaneously the engaging portion of the first connector housing is engaged with the retaining portion of the slide member, the connector housings are easily locked together. The locked connector housings are easily and smoothly unlocked as the engagement of the engaging portion and the retaining portion is released by the unlocking member of the first connector housing.

According to the first aspect of the present invention, the above slidably fitting type connector further comprises:

a flexible arm, on which the retaining portion protrudes, formed on the slide member;

a tapered surface formed on the retaining portion; and an unlocking portion formed on the unlocking member, wherein the unlocking portion abuts against the tapered surface of the retaining portion in accordance with an inward flexion of the flexible arm by pressing the unlocking member.

When the connector housings are unlocked, the unlocking member of the first connector housing is pressed and the flexible arm having the retaining portion is inwardly flexed so as to bring the unlocking portion of the unlocking member into contact with the tapered surface of the retaining portion of the slide member, whereby the engagement of the engaging portion and the retaining portion is released. At this time, the unlocking portion of the unlocking member presses the tapered surface of the retaining portion of the slide member and slightly pushes the slide member in a direction opposite to the fitting direction of the second connector housing from the first connector housing. Accordingly, the work of pulling out the slide member while pressing the unlocking member is facilitated and a special unlocking jig or the like is no longer needed. Thus the connector housings are easily and smoothly released apart.

DETAILED DESCRIPTION OF THE PREFERRED EMBODIMENT

An embodiment of the present invention will now be described with reference to FIGS. 1–5C.

Figure 1:
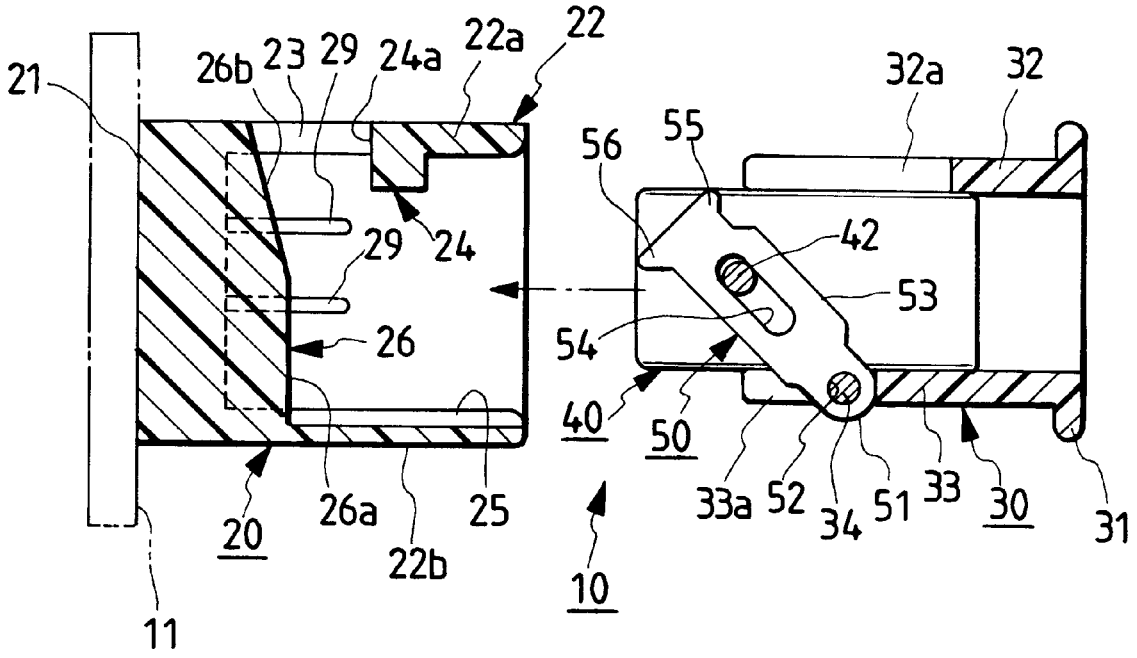
FIG. 1 is a sectional view showing a condition before the housings of a slidably fitting type connector of a preferred embodiment of the present invention are fitted to each other.
Figure 2:
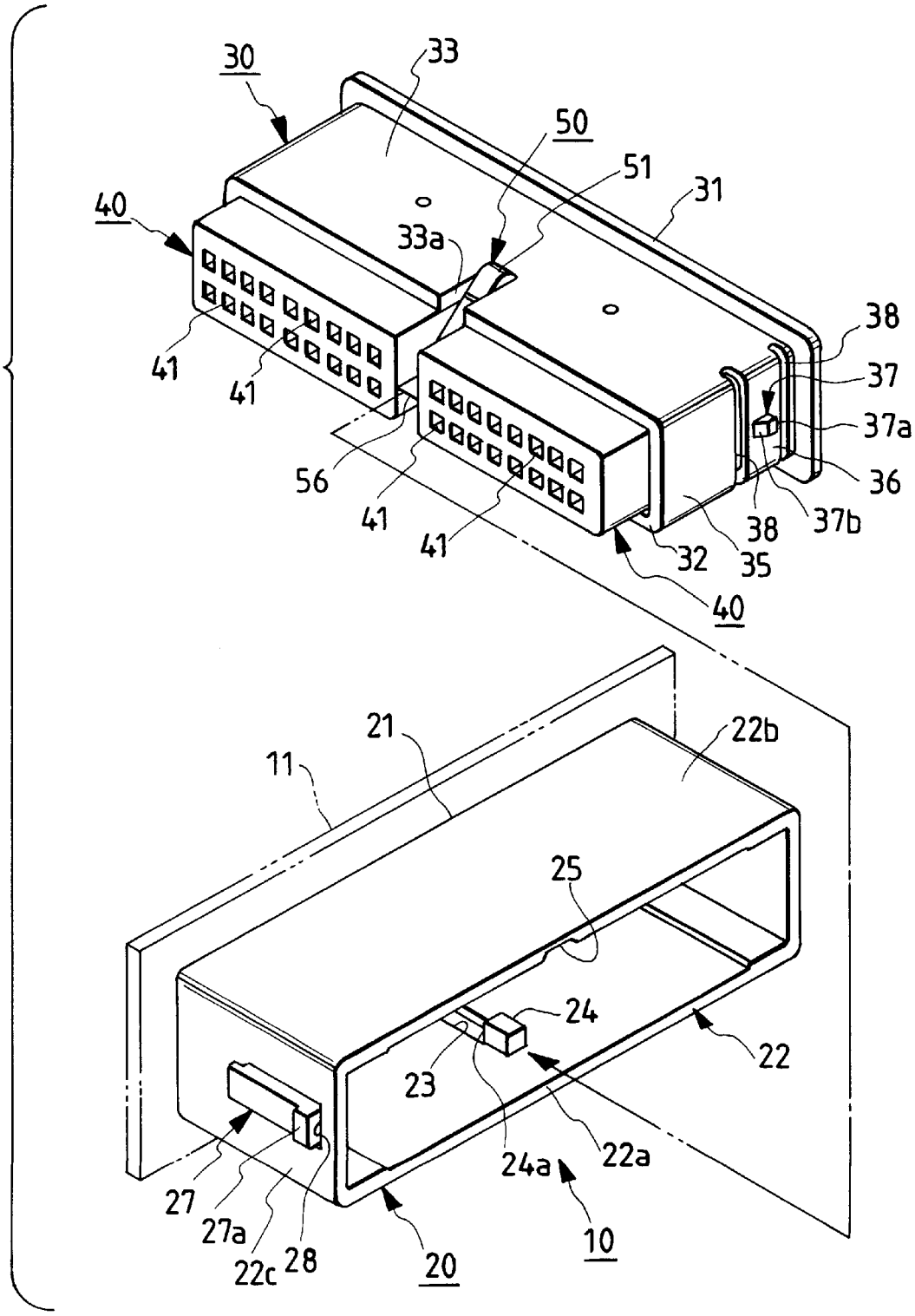
FIG. 2 is a perspective view of a female connector housing and a male connector housing as seen from the bottom side before both housings are fitted to each other.

As shown in FIGS. 1 and 2, a slidably fitting type connector 10 comprises: a female connector housing 20 made of synthetic resin, the female connector housing 20 including a plurality of male terminals 29 projecting from a back wall 21 of a hood portion 22 which is formed in a square-tube like manner, the back side of the back wall 21 being secured to a base board 11; a slide cover 30 made of synthetic resin, and formed in a square-tube like manner, the slide cover 30 being slidably fitted in the hood portion 22 of the female connector housing 20; a pair of rectangular male connector housings 40 and 40 made of synthetic resin, and the male connector housings 40 and 40 being supported in the slide cover 30 to be slidably movable reciprocally; and a lever 50 made of synthetic resin, the lever 50 being provided in the center portion of the slide cover 30, and disposed between the pair of male connector housings 40 and 40. The male connector housings 40 and 40 on the movable side is fitted into the female connector housing 20 on the stationary side, or is detached from the female connector housing 20 due to the leverage of the lever 50 as the lever 50 is swung (pivoted) when the slide cover 30 is slidably moved.

A rectangular opening 23 is formed in the central portion of the upper wall 22*a* of hood portion 22 of the female connector housing 20. A block-like projection 24 is projected from the front end of the opening 23, and is integrally formed with the inner surface of the upper wall 22*a* of the hood portion 22. The back surface of the projection 24 and the front edge surface of the opening 23 form an engaging surface 24*a*. A groove-like recessed portion 25 is formed in the inner-surface-side center of the lower wall 22*b* of the hood portion 22 of the female connector housing 20 and is extended from the front end to the back wall 21. A rib 26 projects from the back end of the recessed portion 25, and is integrally formed with the inner-surface-side center facing the opening 23. A flat surface 26*a* is formed on the rib 26 to extend from the recessed portion 25 up to the center of the rib 26. Further, a tapered surface 26*b* is formed on the rib 26 to extend from the center of the rib 26 toward the opening 23.

As shown in FIGS. 2, 5A, 5B and 5C, a substantially L-shaped flexible unlocking arm 27 is integrally formed with one side wall 22*c* of the hood portion 22 of the female connector housing 20 to protrude from the center of the side wall 22*c*. A U-shaped engaging hole 28 is formed at a periphery of the unlocking arm 27 excluding a coupling portion of the side wall 22*c* of the base portion of the unlocking arm 27. A front end corner portion 27*b* is formed on the front side of the inner surface of a press portion 27*a*. The front end corner portion 27*b* is inwardly projected toward the engaging hole 28 by pressing the press portion 27*a* formed on the front side of the outer surface of the unlocking arm 27.

Figure 3:
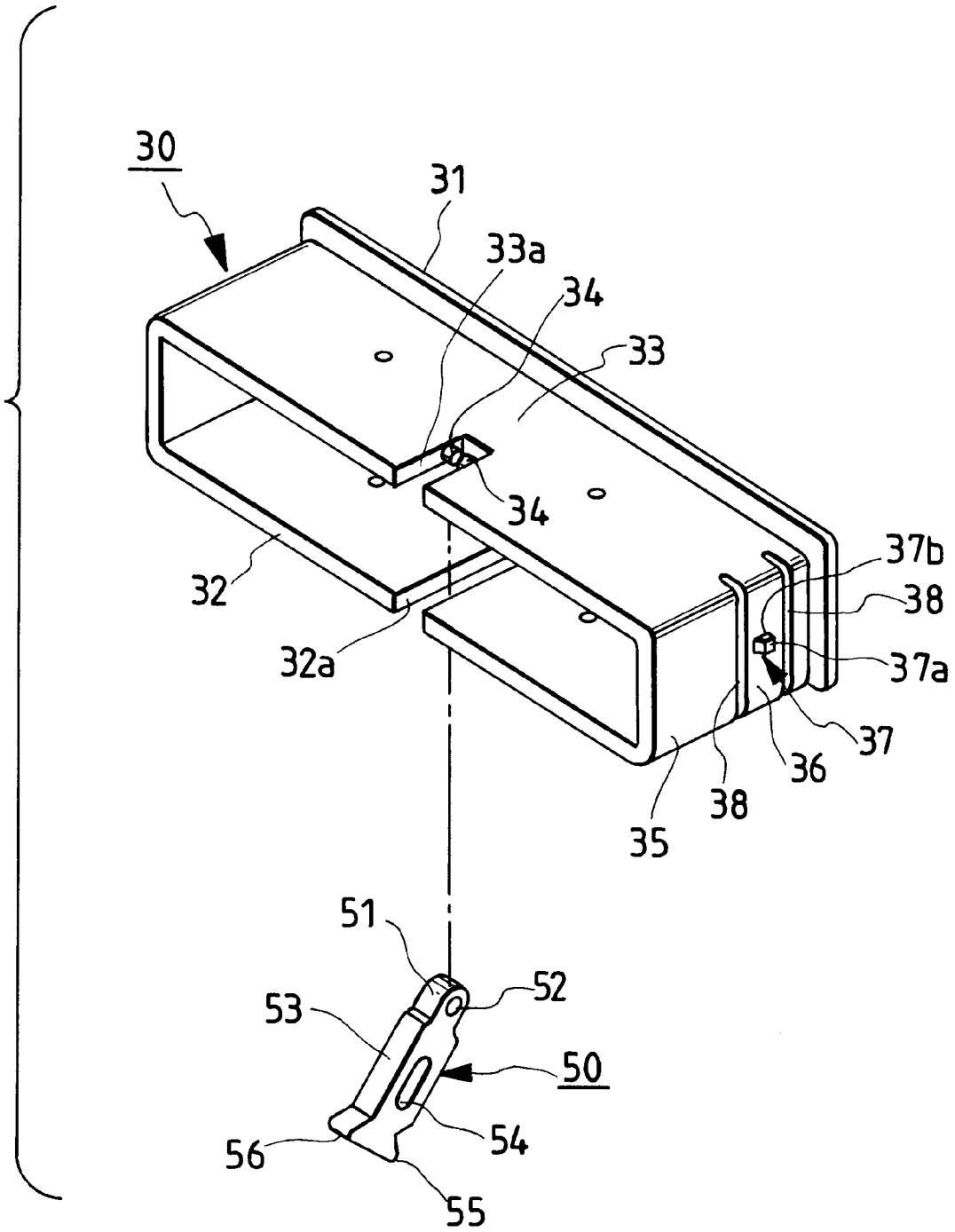
FIG. 3 is a perspective view of a slide cover overlying the male connector housing with a lever movably supported by the slide cover.

As shown in FIGS. 2 and 3, the slide cover 30 is formed in a rectangular-prism-tube-shape. The slide cover 30 is slidable on each of the male connector housings 40, and also is slidable in the hood portion 22 of the female connector housing 20 when the female and male connector housings 20 and 40 are fitted to each other or are detached from each other. An annular collar-like operation portion 31 is integrally formed with and projected from the front end side of the outer peripheral surface of the slide cover 30. Further, a long and a short slit 32*a* and 33*a* are respectively formed in the central opposed positions of the upper and lower walls 32 and 33 of the slide cover 30. Further, a pair of support shafts 34 and 34 are respectively formed on opposed inner surfaces of the short slit 33*a*, and are integrally formed with the opposed inner surfaces of the short slit 33*a*. The support shafts 34 and 34 support the base portion 51 of the lever 50 so that the lever 50 can pivotably move. On the other hand, the front end side of the lever 50 can be inserted into and extracted from the long slit 32*a*.

Figure 5A:
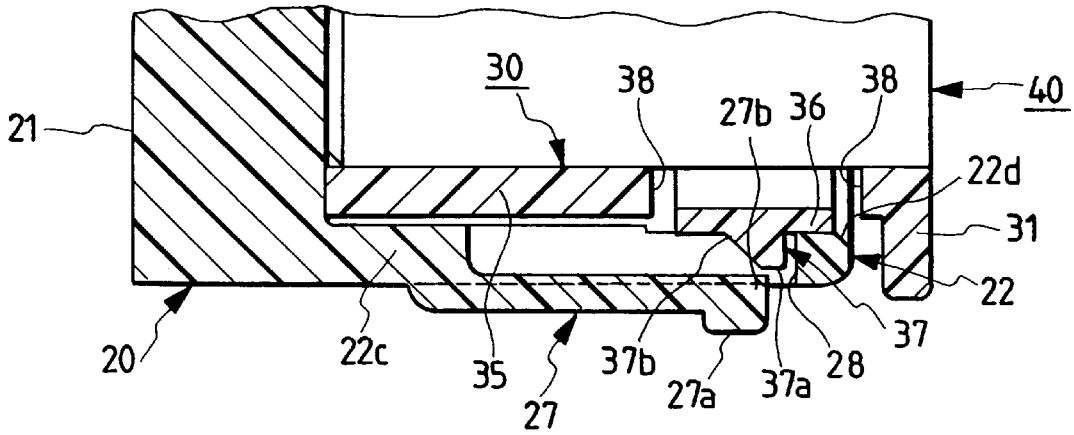
FIG. 5A is a sectional view of a locked condition after the female and male connector housings of the slidably fitting type connector are fitted to each other.

Furthermore, a flexible arm 36 is formed on the central front side of one side wall 35 of the slide cover 30, and is integrally formed with the side wall 35 of the slide cover 30. More specifically, the flexible arm 36 is formed in a thin-wall like manner, and is formed between a pair of slits 38 and 38 provided in parallel to the front side of the side wall 35 of the slide cover 30 so that the flexible arm 36 is elastically deformable inwardly. A retaining portion 37 is protruded from the center of the flexible arm 36, and is integrally formed with the flexible arm 36. The retaining portion 37 has a trapezoidal shape in cross section. As shown in FIG. 5A, a tapered surface 37*b* is formed at a rear side of the retaining portion 37. In other words, the tapered surface 37*b* is formed on a side of the retaining portion 37 toward the unlocking arm 27 of the female connector housing 20. A flat surface 37*a* of the retaining portion 37 is normally brought into contact with or is adjacent to the front end corner portion 27*b* of the unlocking arm 27, so that the female and male connector housings 20 and 40 can be retained together by retaining (locking) the retaining portion 37 of the flexible arm 36 into the engaging hole 28. When the press portion 27*a* of the unlocking arm 27 is operated, the flat surface 37*a* of the retaining portion 37 is pressed by the front end corner portion 27*b* of the unlocking arm 27 to bend the flexible arm 36 inwardly. The front end corner portion 27*b* of the unlocking arm 27 is brought into contact with the tapered surface 37*b* of the retaining portion 37, whereby the retained condition (locked condition) of the retaining portion 37 of the flexible arm 36 in the engaging hole 28 at the side of the unlocking arm 27 is unlocked. In consequence, the slide cover 30 slightly sticks out with respect to the female connector housing 20 and the male connector housing 40 so that the slide cover 30 can be easily pulled out.

As shown in FIG. 2, the male connector housing 40 is formed in a substantially rectangular-shape. The male connector housing 40 has a plurality of terminal receiving chambers 41 extending in the longitudinal direction. The respective terminal receiving chambers 41 receives female terminals (not shown) to be electrically connected to the male terminals 29 of the female connector housing 20 in order to electrically connect both connector housings 20 and 40 when both connector housings 20 and 40 are fitted to each other. A wire harness (not shown) is also connected to each of the female terminal. Further, a lever 50 is installed between the male connector housings 40 and 40. Turning to FIG. 1, columnar support pins 42 are respectively formed to be projected, as a point of action of the lever 50, on the central front side of the side surfaces of the male connector housings 40 opposing each other by monolithic molding or press-inserting.

The lever 50 is formed in a substantially rectangular-shape. A circular hole 52 is formed in the center of a base portion 51 that is formed into an arcuate shape. The base portion 51 of the lever 50 is pivotally movable by fitting the pair of support shafts 34 and 34 formed in the short slit 33*a* into the circular hole 52. Further, a long hole 54 is formed in a mid-portion 53 of the lever 50 as a point-of-action receiving portion. The support pins 42 of the male connector housings 40 are slidably engaged with the long hole 54. A pair of leading end portions 55 and 56 are formed on the front end side of the lever 50, and respectively have a substantially triangular shape. The leading end portion 55 on the front side of the lever 50 can be engaged with or disengaged from the projection 24 of the female connector housing 20 as one engaging portion. On the other hand, the leading end portion 56 on the back side of the lever 50 can be engaged with or disengaged from the rib 26 of the female connector housing 20 as the-other-side engaging portion. Further, a distance from the base portion 51 of the lever 50 to the mid-portion 53 pivotally supported by the support pins 42 of the male connector housings 40 is longer than a distance from the mid-portion 53 to the leading end portions 55 and 56.

Figure 4A:
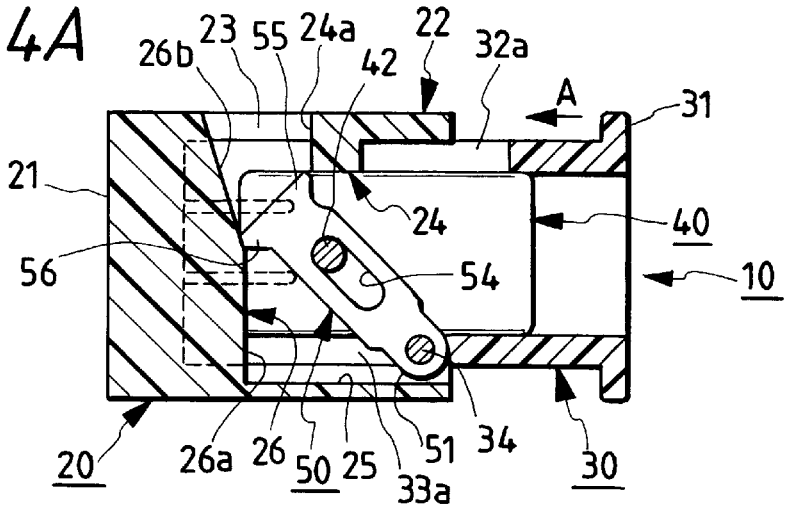
FIG. 4A is a sectional view when the fitting of the male connector housing into the female connector housing is started.

According to the slidably fitting type connector 10 of the preferred embodiment of the present invention, the lever 50 is inclined by the support shaft 34 of the slide cover 30 and the support pins 42 of the respective connector housings 40 before the female connector housing 20 and the male connector housings 40 are fitted to each other as shown in FIGS. 1 and 2. As shown in FIG. 4A, the leading end side of the slide cover 30 containing the male connector housings 40 is inserted to be temporarily fitted into the hood portion 22 of the female connector housing 20 on the stationary side. After that, the leading end portion 56 on the back side of the lever 50 is slid on and brought into contact with the flat surface 26*a* to the tapered surface 26*b* of the rib 26 formed in the hood portion 22 of the female connector housing 20, as the slide cover 30 is further pressed into the hood portion 22 in the fitting direction of both connector housings 20 and 40 (i.e., in the direction of an arrow A shown in FIG. 4A). Only the lever 50 is rotated by the initial forward movement of the slide cover 30. After that, the leading end portion 55 on the front side of the lever 50 is upwardly moved and enters in the opening 23 of the female connector housing 20. After that, the leading end portion 55 on the front side of the lever 50 is brought into contact with the engaging surface 24*a* of the projection 24 so as to form a fulcrum as shown in FIG. 4B.

Figure 4B:
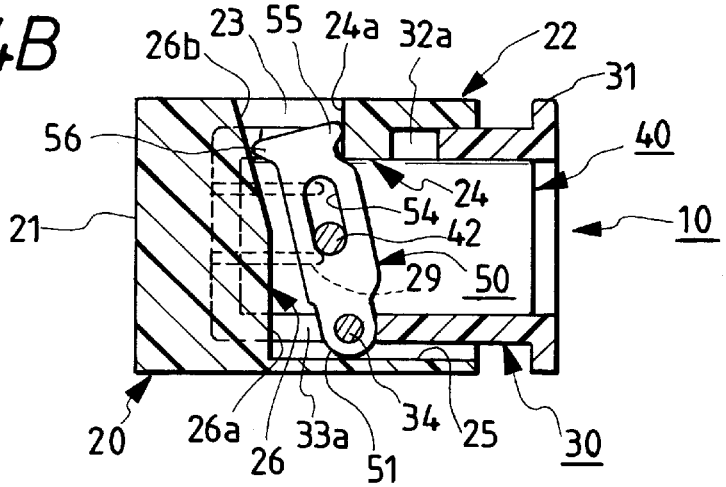
FIG. 4B is a sectional view while both housings are being fit to each other.
Figure 4C:
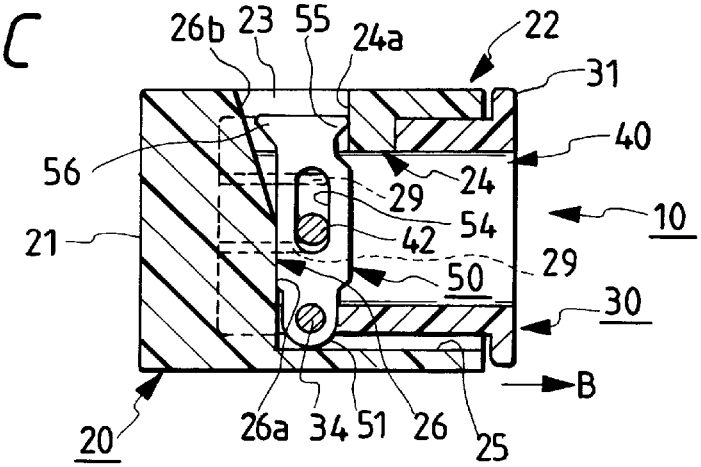
FIG. 4C is a sectional view when both housings are completely fit to each other.

As shown in FIG. 4C, each of the male connector housings 40 is inserted into the hood portion 22 of the female connector housing 20 due to leverage of the lever 50 as the slide cover 30 is further pushed in the fitting direction from the state of FIG. 4B. In other words, each of the male connector housings 40 is pushed into the hood portion 22 of the female connector housing 20 in accordance with the leverage with the circular hole 52 of the base portion 51 of the lever 50 serves as a point of force application, the support pins 42 of the male connector housings 40 serve as a point of action, and the leading end portion 55 on the front side of the lever 50 serves as a fulcrum. As a result, both connector housings 20 and 40 are fitted to each other. At the time of the fitting, the retaining portion 37 of the slide cover 30 is retained in the engaging hole 28 of the female connector housing 20 as shown in FIG. 5A, whereby the fitted condition of the both connector housings 20 and 40 is locked.

In more detail, when both connector housings 20 and 40 are about to be fitted to each other, the tapered surface 37*b* of the retaining portion 37 of the slide cover 30 abuts against an inner edge 22*d* of one side portion 22*c* of the hood portion 22 of the female connector housing 20 so that the flexible arm 36 is inwardly flexed. The retaining portion 37 of the slide cover 30 is retained in the engaging hole 28 of the female connector housing 20, and simultaneously, the flexible arm 36 is restored to its initial state. Accordingly, the fitted condition of both connector housings 20 and 40 is smoothly locked. Further, the base portion 51 of the lever 50 is guided by the recessed portion 25 of the female connector housing 20 until the retaining portion 37 of the slide cover 30 is locked in the engaging hole 28 of the female connector housing 20, whereby the slide cover 30 is smoothly and slidably moved without any play.

Figure 5B:
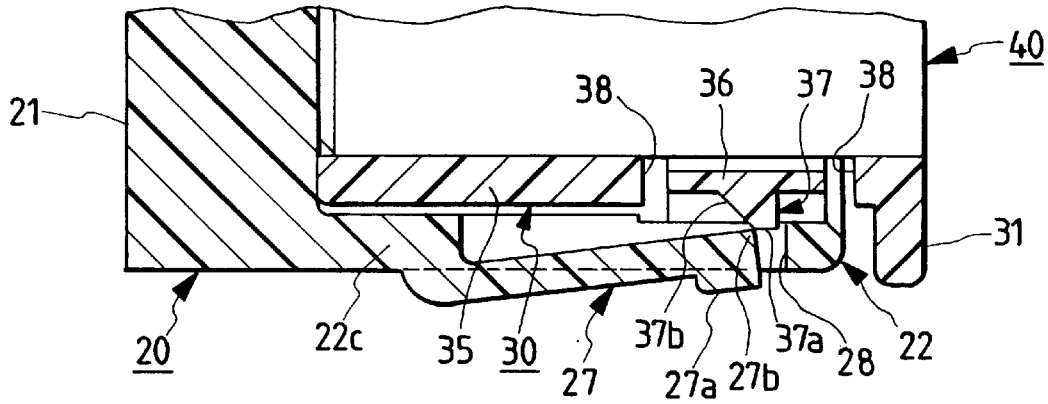
FIG. 5B is a sectional view while the housings are being unlocked.
Figure 5C:
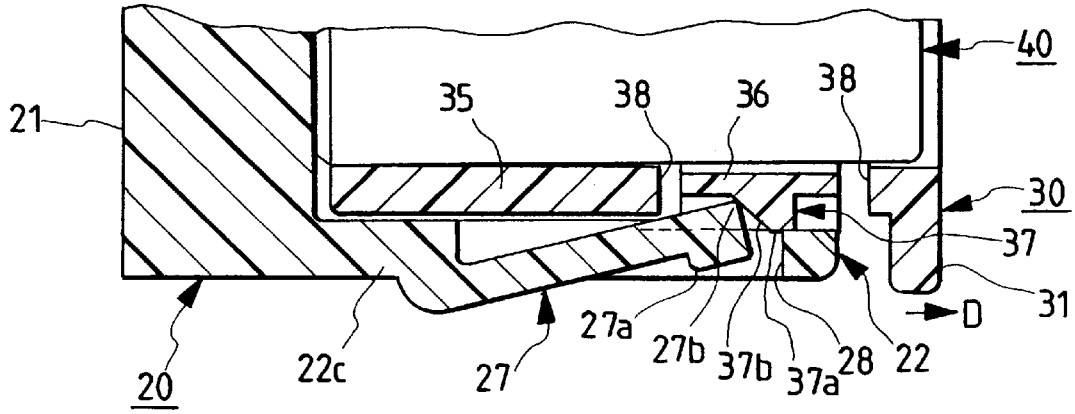
FIG. 5C is sectional view when the housings are completely unlocked.
Figure 6A:
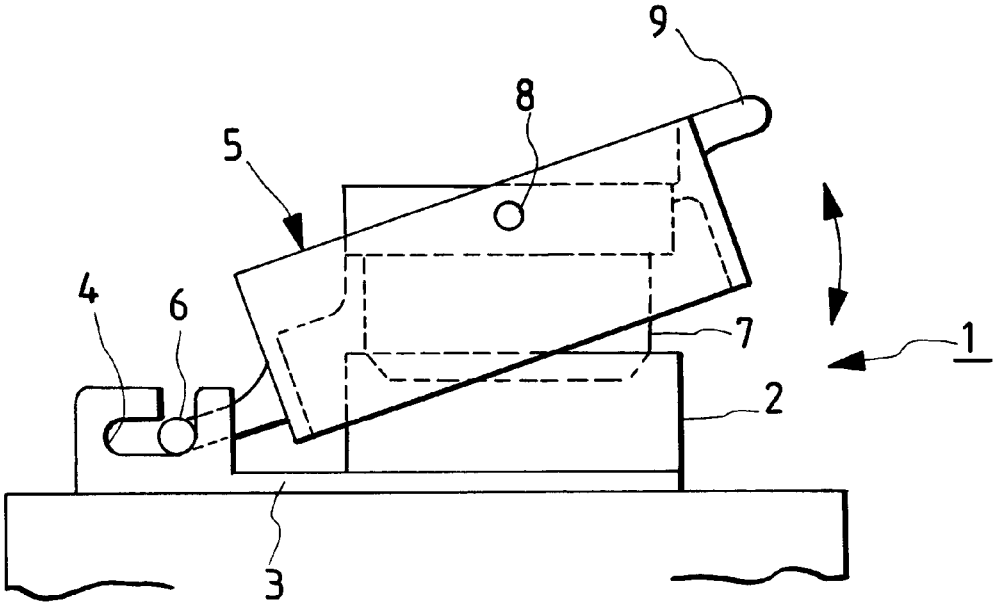
FIG. 6A PRIOR ART
FIG. 6A is a diagram illustrating a conventional lever type connector.
Figure 6B:
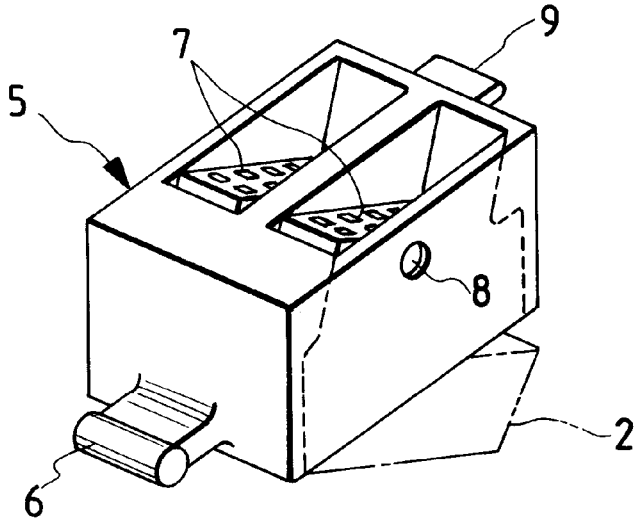
FIG. 6B PRIOR ART
FIG. 6B is a perspective view of the lever side of the lever type connector of FIG. 6A.

When the above fitted condition is released, the flat surface 37*a* of the retaining portion 37 of the slide cover 30 is pressed by the front end corner portion 27*b* of the unlocking arm 27 as the unlocking arm 27 of the female connector housing 20 is pressed as shown in FIG. 5B. As a result, the flexible arm 36 of the slide cover 30 is inwardly flexed and the front end corner portion 27*b* of the unlocking arm 27 abuts against the tapered surface 37*b* of the retaining portion 37. As shown in FIG. 5C, the locked condition of the retaining portion 37 of the flexible arm 36 and the engaging hole 28 on the unlocking arm side 27 is released, and the slide cover 30 is slightly pushed outwardly in a direction of an arrow D shown in FIG. 5C with respect to the female connector housing 20 and the male connector housings 40. Accordingly, the slide cover 30 can be easily pulled out as the slide cover 30 is pushed outwardly as shown in FIG. 5C. Both connector housings 20 and 40 are detached from each other due to the leverage of the lever 50 because the leading end portion 56 on the back side of the lever 50 which abuts against the tapered surface 26*b* of the rib 26 serves as a fulcrum as the slide cover 30 is pulled out. In other words, connector housings 20 and 40 are detached from each other in accordance with the leverage in that the circular hole 52 of the base portion 51 of the lever 50 serves as a point of force application, the support pins 42 of the male connector housings 40 serve as a point of action, and the leading end portion 56 on the rear side of the lever 50 serves as the fulcrum when the slide cover 30 is pulled out in a direction of an arrow B shown in FIG. 4C.

Thus, the slide cover 30 is slidably movable in the fitting and detaching directions of the male and female connector housings. When the slide cover 30 is moved forwardly, the leading end portion 55 on the front side of the lever 50 is abutted against the engaging surface 24*a* of the projection 24 of the female connector housing 20, and each of the male connector housings 40 is pulled into the female connector housing 20 so that connector housings 20 and 40 are fitted to each other. When the slide cover 30 is moved backwardly, the leading end portion 56 on the back side of the lever 50 is abutted against the tapered surface 26*b* of the rib 26 so that the connector housings 20 and 40 are detached from each other. Therefore, the fitting and detaching work of the connector housings 20 and 40 is easily achieved by merely sliding the slide cover 30 in the fitting and detaching directions of connector housings 20 and 40 with a small operation force. In particular, since the fitting work of the connector housings 20 and 40 is easily achieved by merely pushing the slide cover 30 in the fitting direction, the connector housings 20 and 40 can be fitted to each other smoothly and quickly in a short time period without requiring skilled operation even if the connecting work is performed in a small mounting space where the female connector housing 20 on the stationary side is not precisely seen, for example.

Furthermore, since the lever 50 is contained in the slide cover 30 and never projects outwardly from the slidably fitting type connector 10, the lever 50 is prevented from damage by external loading force. Accordingly, the function of leverage of the lever 50 (i.e., fitting function with a small operation force) never drops, and always both connector housings 20 and 40 are easily and surely fitted to each other. Furthermore, the length of the lever 50 can be shortened as much as possible and the whole connector can be made compact to this extent accordingly. Moreover, the leverage of one lever 50 provided in the center of the slide cover 30 is utilizable for easily and surely fitting and detaching multi-pole female and male connector housings 20 and 40. Thus, the number of parts and the manufacturing cost of the whole connector can be reduced.

When the connector housings 20 and 40 are unlocked, the flexible arm 36 having the retaining portion 37 projected thereon is inwardly flexed by pressing the press portion 27*a* of the unlocking arm 27 of the female connector housing 20. Then, the retaining portion 37 of the slide cover 30 is easily unlocked from the engaging hole 28 of the female connector housing 20 as the front end corner portion 27*b* of the unlocking arm 27 abuts against the tapered surface 37*b* of the retaining portion 37 of the slide cover 30. The front end corner portion 27*b* of the unlocking arm 27 of the female connector housing 20 presses the tapered 37*b* of the retaining portion 37 of the slide cover 30, and the slide cover 30 is slightly pushed outwardly from the female connector housing 20. Accordingly, the work of pulling out the slide cover 30 while pressing the unlocking arm 27 is facilitated and the unlocking jig such as a screwdriver is no longer needed, so that the connector housings 20 and 40 are easily and smoothly unlocked.

Although only one lever is provided in the center of the slide cover in the above embodiment of the present invention, more than one lever may be provided. Furthermore, although the lever is provided on the male connector housing side, the lever may be provided on the female connector housing side.

What is claimed is:

1. A slidably fitting connector comprising:

a first connector housing having an engaging portion, an unlocking member, and first and second engaging portions formed therein;

a second connector housing fittable to the first connector housing and having a point-of-action portion formed thereon;

a slide member slidably movable on the second connector housing in fitted and detached directions of the second connector housing to and from the first connector housing, the slide member having a retaining portion engageable with and disengageable from the engaging portion, and a support shaft; and a lever pivotably supported by the support shaft, the lever includes:

a base portion pivotably supported by the support shaft, a mid-portion engaged with the point-of-action portion of the second connector housing, and a leading end portion engageable with and disengageable from the first and second engaging portions of the first connector housing when the first and second connector housings are fitted to each other and detached from each other, wherein the lever pivots as the slide member is slid on the second connector housing, and wherein a fitted condition of the first and second connector housings is retained by an engagement of the retaining portion of the slide member and the engaging portion of the first connector housing, the engagement of the retaining portion and the engaging portion can be released by operating the unlocking member.

2. The slidably fitting connector of claim 1, wherein when the slide member is moved in the fitting direction of the second connector housing, the leading end portion engages with the first engaging portion so that the first and second connector housings are pulled to each other.

3. The slidably fitting connector of claim 1, wherein when the slide member is moved in the detaching direction of the second connector housing, the leading end portion engages with the second engaging portion so that the first and second connector housings are pulled apart from each other.

4. The slidably fitting connector of claim 1, wherein the retaining portion is formed on the slide member, the engaging portion is formed in the first connector housing, and the unlocking member is arranged on the first connector housing.

5. The slidably fitting connector of claim 1, further comprising:

a flexible arm, on which the retaining portion is protruded, formed on the slide member;

a tapered surface formed on the retaining portion; and an unlocking portion formed on the unlocking member, wherein the unlocking portion abuts against the tapered surface of the retaining portion in accordance with an inward flexion of the flexible arm by pressing the unlocking member.

6. The slidably fitting connector of claim 4, further comprising:

a flexible arm, on which the retaining portion is protruded, formed on the slide member;

a tapered surface formed on the retaining portion; and an unlocking portion formed on the unlocking member, wherein the unlocking portion abuts against the tapered surface of the retaining portion in accordance with an inward flexion of the flexible arm by pressing the unlocking member.

7. A connector comprising:

a first housing defining a cavity;

a second housing for insertion into the cavity of the first housing and having a support shaft;

a slide member movable on the second housing and having a support shaft; and a lever pivotally mounted on the slide member support shaft and slidably mounted on the second housing support shaft wherein the lever pivots when the slide member moves relative to the second housing.

8. The connector of claim 7, wherein the first housing has first and second engaging portions formed therein, and the lever includes a leading end portion engageable with and disengageable from the first and second engaging portions of the first housing when the first and second housings are fit to and detached from each other.

9. The connector of claim 8, wherein the leading end portion of the lever engages the first engaging portion so that the first and second housings are pulled to each other when the slide member and the second housing are moved together into the first housing.

10. The connector of claim 8, wherein the leading end portion of the lever engages the second engaging portion so that the first and second connector housings when the slide member and the second housing are pulled from the first housing.

11. The connector of claim 7, further comprising:

a flexible arm formed on the slide member, the flexible arm having a retaining portion and a tapered surface formed on the retaining portion; and an unlocking member formed on the first housing, the unlocking member including an unlocking portion, wherein the unlocking portion abuts against the tapered surface of the retaining portion when the slide member and second housing are located in the first housing and the unlocking member is pressed.

12. A connector comprising:

a first housing defining a cavity and having a first engaging portion in the cavity;

a second housing for insertion into the cavity of the first housing;

a slide member movable on the second housing and having a support shaft; and a lever supported on the slide member support shaft, wherein the lever contacts the first engaging portion when the second housing and the slide member are inserted into the first housing.

13. The connector of claim 12, wherein the first housing has a second engaging portion formed in the cavity, the second housing has a point-of-action portion formed thereon, and the lever includes a mid-portion that engages with the point-of-action portion of the second housing and a leading end portion engageable with and disengageable from the first and second engaging portions of the first housing when the first and second housings are fit to and detached from each other.

14. The connector of claim 13, wherein the leading end portion of the lever engages the first engaging portion so that the first and second housings are pulled to each other when the slide member and the second housing are moved together into the first housing.

15. The connector of claim 13, wherein the leading end portion of the lever engages the second engaging portion so that the first and second connector housings when the slide member and the second housing are pulled from the first housing.

16. The connector of claim 12, further comprising:

a flexible arm formed on the slide member, the flexible arm having a retaining portion and a tapered surface formed on the retaining portion; and an unlocking member formed on the first housing, the unlocking member including an unlocking portion, wherein the unlocking portion abuts against the tapered surface of the retaining portion when the slide member and second housing are located in the first housing and the unlocking member is pressed.

17. The connector of claim 7, wherein the lever defines a first hole adjacent to an end of the lever and a second hole proximate a middle of the lever, the slide member support shaft is located in the first hole, and the second housing support shaft is located in the second hole.

18. A slidably fitting connector, comprising:

a first connector housing having an engaging portion and an unlocking member;

a second connector housing fittable to the first connector housing;

a slide member slidably movable on the second connector housing in fitted and detached directions of the second connector housing to and from the first connector housing, the slide member having a retaining portion engageable with and disengageable from the engaging portion, and a support shaft; and a lever pivotably supported by the support shaft, wherein the lever pivots as the slide member is slid on the second connector housing, and wherein a fitted condition of the first and second connector housings is retained by an engagement of the retaining portion of the slide member and the engaging portion of the first connector housing, the engagement of the retaining portion, and the engaging portion can be released by operating the unlocking member.

* * * * *